US005278403A

United States Patent [19]

Alfano et al.

[11] Patent Number: 5,278,403

[45] Date of Patent: Jan. 11, 1994

[54] FEMTOSECOND STREAK CAMERA

[76] Inventors: Robert R. Alfano; Yoshihiro Takiguchi, both of 3777 Independence Ave., Bronx, N.Y. 10463; Katsuyuki Kinoshita, 5-2-31 Sumiyoshi, Hamamatsu City, Japan, 430

[21] Appl. No.: 693,242

[22] Filed: Apr. 29, 1991

[51] Int. Cl.[5] ..... H01J 31/50; H01J 40/14

[52] U.S. Cl. ..... 250/214 VT; 313/537; 313/376

[58] Field of Search ..... 250/213VT; 313/376, 525, 313/537, 105CM

[56] References Cited

U.S. PATENT DOCUMENTS

| | | | |
|---|---|---|---|
| 3,463,960 | 8/1969 | Gebel | 250/213 |
| 4,120,002 | 10/1978 | Lieber | 358/111 |
| 4,215,274 | 7/1980 | Segall | 250/361 R |
| 4,350,919 | 9/1982 | Johnson et al. | 313/99 |
| 4,467,189 | 8/1984 | Tsuchiya | 250/213 VT |
| 4,645,918 | 2/1987 | Tsuchiya et al. | 250/213 VT |
| 4,659,921 | 4/1987 | Alfano | 250/213 VT |
| 4,682,020 | 7/1987 | Alfano | 250/213 VT |
| 4,853,595 | 8/1989 | Alfano et al. | 313/532 |
| 4,891,581 | 1/1990 | Takiguchi | 324/96 |
| 4,902,927 | 2/1990 | Kinoshita | 313/376 |
| 4,942,293 | 7/1990 | Koishi et al. | 250/214 VT |
| 4,956,548 | 9/1990 | Alfano et al. | 250/214 VT |
| 4,958,231 | 9/1990 | Tsuchiya | 358/211 |
| 5,101,100 | 3/1992 | Kinoshita et al. | 250/214 VT |
| 5,180,908 | 1/1993 | Suyama | 250/214 VT |
| 5,221,836 | 6/1993 | Kinoshita | 250/214 VT |

FOREIGN PATENT DOCUMENTS 0424148 4/1991 European Pat. Off. ..... H01J 31/50

OTHER PUBLICATIONS

Kinoshita et al, "Femtosecond streak tube," Review of Scientific Instruments, vol. 58, No. 6, pp. 932–938, Jun. 1987, New York, USA.

Gitomer et al., Nuclear Instruments and Methods, vol. 159, No. 2/3, pp. 331–335 (1979) Amsterdam, NL.

Kujawa et al., Optik, vol. 86, No. 2, pp. 39–46 (Nov. 1990) Stuttgart, DE.

Kinoshita, "Femtosecond Streak Tube", Review of Scientific Instruments vol. 58, No. 6, pp. 932–938, Jun. 1987.

Kinoshita et al, "Femtosecond streak tube," SPIE vol. 1358, pp. 490∝496 (Sep. 1990).

Schiller et al., "An ultrafast streak camera system: temporaldisperser and analyzer," Optical Spectra (Jun. 1980).

*Primary Examiner*—Michael T. Razavi
*Assistant Examiner*—Joseph Colaianni
*Attorney, Agent, or Firm*—Kriegsman & Kriegsman

[57] ABSTRACT

A streak camera having improved time resolving capacity in the femtosecond regime. The streak camera uses magnetic and/or electric fields in such a way as to minimize the adverse effects of angular distribution and energy distribution of photoelectrons simultaneously emitted from a photocathode in response to the impinging of light thereon. In one embodiment, the streak camera comprises a streak camera tube including a housing, the housing having disposed therein a photocathode, an aperture sized to selectively permit the passage therethrough of substantially on-axis photoelectrons, an accelerating mesh, a pair of focusing electrodes or a cylindrical focusing electrode for focusing the photoelectrons into a beam, a pair of isolation plates or an isolation cylindrical, means for creating an electric field and/or a magnetic field, whereby the beam of photoelectrons passing therethrough is caused to be dispersed into a plurality of trajectories in accordance with the distribution of velocities of the photoelectrons, an aperture sized to selectively permit the passage therethrough of photoelectrons traveling along a narrow band of trajectories, i.e. photoelectrons within a narrow velocity range, a pair of sweep electrodes, a microchannel plate, and a phosphor screen. The streak camera also includes an input slit disposed in front of the photocathode and optics for imaging the input slit on the photocathode. To minimize dispersion of the optical pulse as it is focused onto the photocathode, the optics preferably include a mirror arrangement instead of a lens system.

34 Claims, 5 Drawing Sheets

FEMTOSECOND STREAK CAMERA

BACKGROUND OF THE INVENTION

The present invention relates generally to streak cameras and more particularly to a novel streak camera having improved time resolution in the femtosecond time domain.

Streak cameras, which are about fifteen years old in the art, are used primarily to directly measure the time dynamics of luminous events, i.e., to directly time resolve a light signal. A typical streak camera includes a rectangular entrance slit, input relay optics, a streak camera tube including a housing having disposed therein a photocathode, an accelerating mesh, a pair of sweeping electrodes, a microchannel plate, and a phosphor screen, and output relay optics for imaging the streak image formed on the phosphor screen onto an external focal plane. The image at the external focal plane is then either photographed by a conventional still camera or by a video camera.

In use, photons of an incident light pulse pass through the entrance slit and are collected and focused by the input relay optics onto the photocathode of the streak tube to produce emissions of electrons proportional to the intensity of the incident light pulse. The electrons are then accelerated into the streak tube via the accelerating mesh and are electrostatically swept at a known rate over a known distance, thereby converting temporal information into spatial information. These electrons then strike the microchannel plate, which produces electron multiplication through secondary emission. The secondary electrons then impinge upon a phosphor screen to form a streak image. The streak image thus serves as a luminescent "fingerprint" of the time resolved characteristics of the incident light pulse.

An illustrative example of a streak camera is disclosed in U.S. Pat. No. 4,467,189 to Y. Tsuchiya, wherein there is disclosed a framing tube (i.e., streak camera tube) which includes a cylindrical airtight vacuum tube, a shutter plate, and a ramp generator. The container has a photocathode at one end thereof and a fluorescent screen at the other end thereof which is opposite to the photocathode. The shutter plate is disposed between and parallel to the surface of the photocathode and fluorescent screen and has a multiplicity of through holes perforated perpendicular to its surface. The shutter plate also carries at least three electrodes that are disposed perpendicular to the axis of the through holes and spaced parallel to each other. The electrodes divide the surface of the shutter plate into a plurality of sections. The ramp generator is connected to the electrodes. The ramp voltage generated changes in such a manner as to reverse its polarity, producing a time lag between the individual electrode. Developing an electric field across the axis of the through holes in the shutter screen, the ramp voltage controls the passage of the electron beams from the photocathode through the through holes. A framing camera includes the above-described framing tube and an optical system. The optical system includes a semitransparent mirror that breaks up the light from the object under observation into a plurality of light components and a focusing lens disposed in the path through which each of the light components travels. Each of the light components corresponds to each of the sections on the shutter plate. The images of a rapidly changing object are reproduced, at extremely short time intervals, on different parts of the fluorescent screen.

Other U.S. patents relating to streak cameras include U.S. Pat. No. 4,714,825 to Oba; U.S. Pat. No. 4,682,020 to Alfano; U.S. Pat. No. 4,661,694 to Corcoran; U.S. Pat. No. 4,659,921 to Alfano; U.S. Pat. No. 4,645,918 to Tsuchiya et al.; U.S. Pat. No. 4,630,925 to Schiller et al.; U.S. Pat. No. 4,435,727 to Schiller et al.; U.S. Pat. No. 4,413,178 to Mourou et al.; U.S. Pat. No. 4,327,285 to Bradley; U.S. Pat. No. 4,323,811 to Garfield;

Additionally, articles relating to streak cameras include N. H. Schiller et al., "An Ultrafast Streak Camera System: Temporaldisperser and Analyzer," *Optical Spectra* (June 1980); N. H. Schiller et al., "Picosecond Characteristics of a Spectrograph Measured by a Streak Camera/Video Readout System," *Optical Communications*, Vol. 35, No. 3, pp. 451–454 (December 1980); and C. W. Robinson et al., "Coupling an Ultraviolet Spectrograph to a Schloma for Three Dimensional Picosecond Fluorescent Measurements," *Multichannel Image Detectors*, pp. 199–213, ACS Symposium Series 102, American Chemical Society.

Many of the above-described streak cameras have time resolutions in the picosecond range, with some as short as 500 femtoseconds (fs). However, with the now routine generation of laser pulses as short as 30 fs, the detection of luminous events on the 30 fs scale is now important. Accordingly, there is a need for a streak camera whose time resolution is better than existing streak cameras and is preferably in the 30 fs scale.

SUMMARY OF THE INVENTION

It is an object of the present invention to provide a new and improved streak camera.

It is another object of the present invention to provide a streak camera having improved time resolution, preferably in the 30 fs scale.

One parameter which affects the time resolution of streak cameras is the time spread caused by the initial velocity (energy) distribution of photoelectrons emitted from the photocathode at the same time. Typically, the initial velocity distribution is Gaussian. As can readily be appreciated, the time resolution of a streak camera is affected by the aforementioned velocity distribution since photoelectrons emitted from the photocathode at the same time but at different velocities are swept by the sweeping electrodes at different times and, consequently, strike the phosphor screen at different locations.

Consequently, in accordance with one feature of the present invention, the streak camera tube is constructed so that only those photoelectrons having a velocity (an energy) falling within a narrow velocity (energy) range are permitted to reach the sweeping electrodes. This is accomplished, for example, by subjecting all of the photoelectrons emitted from the photocathode to a centrifugal force, which causes the trajectories of the respective photoelectrons to be bent according to their relative velocities (energies), and then using an aperture to permit only those photoelectrons traveling along a narrow band of trajectories to pass through to the sweeping electrodes.

In accordance with another feature of the present invention, the streak tube is constructed so that the disparity in the velocities of the various photoelectrons emitted by the photocathode at any given time is compensated for by having the faster moving photoelectrons travel a proportionately greater distance to the sweeping electrodes than the slower moving photoelectrons in such a way as to effectively compress the electron pulse. This is accomplished, for example, with a serial arrangement of four magnets, electro-magnets, electrostatic plates, or the like, which impart centrifugal forces of different directions to the photoelectrons in such a way as to cause the photoelectrons to travel path lengths corresponding to their respective velocities and then to be recombined into a single beam to be swept by the sweeping electrodes.

Another parameter which affects the time resolution of streak cameras is the angular directional distribution of photoelectrons emitted by the photocathode at any given time. Typically, the angular distribution of photoelectrons is a cosine squared distribution. As can readily be appreciated, such an angular distribution of photoelectrons results in the phosphor screen being illuminated at a variety of locations along its vertical axis. Consequently, in accordance with another feature of the present invention, the streak tube is constructed to permit only those photoelectrons which are emitted from the photocathode substantially along the streak tube axis to be swept by the sweeping electrodes and to impinge on the phosphor screen. This is accomplished, for example, by placing a horizontally-extending slit within the streak tube at a short distance from the photocathode, the slit being appropriately sized so as to permit only photoelectrons emitted along the streak tube axis to pass therethrough.

Other objects, features, and advantages will appear from the description to follow. In the description, reference is made to the accompanying drawings which form a part thereof, and in which are shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. Therefore, the following detailed description is not to be taken in a limiting sense, and the scope of the present invention is best defined by the appended claims.

BRIEF DESCRIPTION OF THE DRAWINGS

In the accompanying drawings wherein like reference numerals represent like parts.

DETAILED DESCRIPTION OF PREFERRED EMBODIMENTS

Figure 1:
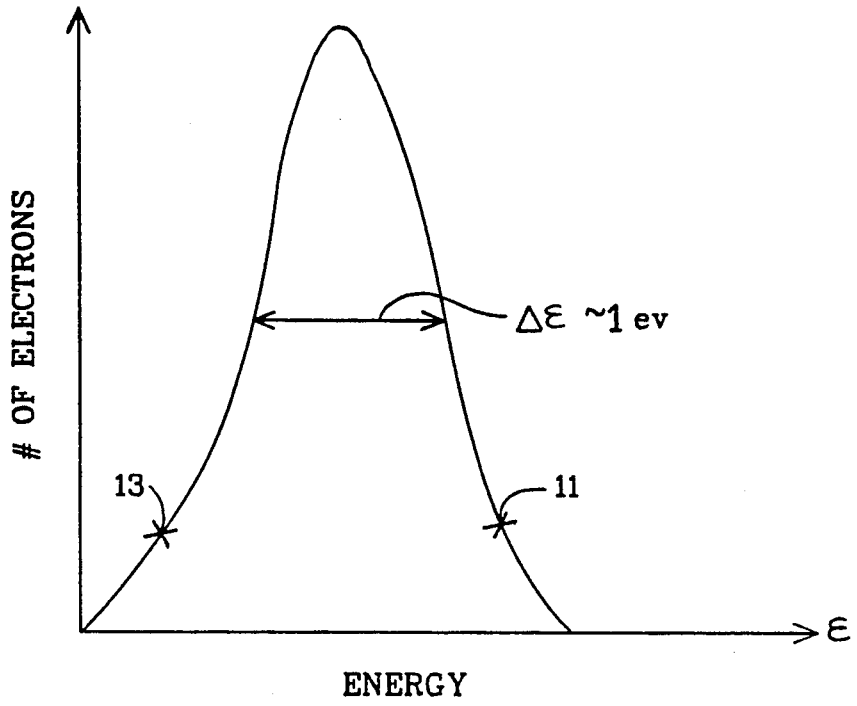
FIG. 1 is graphic representation of a typical initial energy distribution for a group of photoelectrons simultaneously emitted from a photocathode.

Referring now to the drawings and, in particular, to FIG. 1, there is shown a graph depicting a typical initial energy distribution for a group of photoelectrons which have been simultaneously emitted from a conventional photocathode in response to the impinging of light thereon, the distribution being generally Gaussian in shape. Typically, the distribution of energy covers a spread on the order of 1 eV (electron volt). Since the amount of energy possessed by a photoelectron and its velocity are related, those photoelectrons located towards the high end of the energy distribution, e.g. photoelectrons 11, have a relatively high velocity whereas those photoelectrons located towards the low end of the energy distribution, e.g. photoelectrons 13, have a relatively low velocity. As can readily be appreciated, one consequence of this variation in velocity is that photoelectrons simultaneously emitted from a photocathode into a streak camera tube arrive at the sweeping electrodes at different times and, therefore, impinge upon the phosphor screen at different locations along its vertical axis. This phenomenon is commonly referred to as time broadening and is the major component in the time resolving capacity of a streak camera. The relationship between the initial energy distribution and time broadening can be expressed mathematically as $$\Delta t = 2.3 \times 10^{-6} \frac{\sqrt{\Delta\epsilon}}{E} \tag{1}$$

where $\Delta t$ is the time broadening $\Delta\Sigma$ is the full width at half maximum of the energy distribution of photoelectrons simultaneously emitted from the photocathode, and E is the electric field strength of the accelerating mesh. As can readily be appreciated from equation (1), reduction in $\Delta\Sigma$ from about 1 eV to about $10^{-4}$ eV causes a $10^{-2}$ reduction in $\Delta t$. Also from equation (1), it can be determined that the energy spreads $\Delta\Sigma$ that would be required for 100 fs and 50 fs time resolutions $\Delta t$, where $E=6\times10^{6}$ V/m, would be 0.067 eV and 0.016 eV, respectively.

Figure 2:
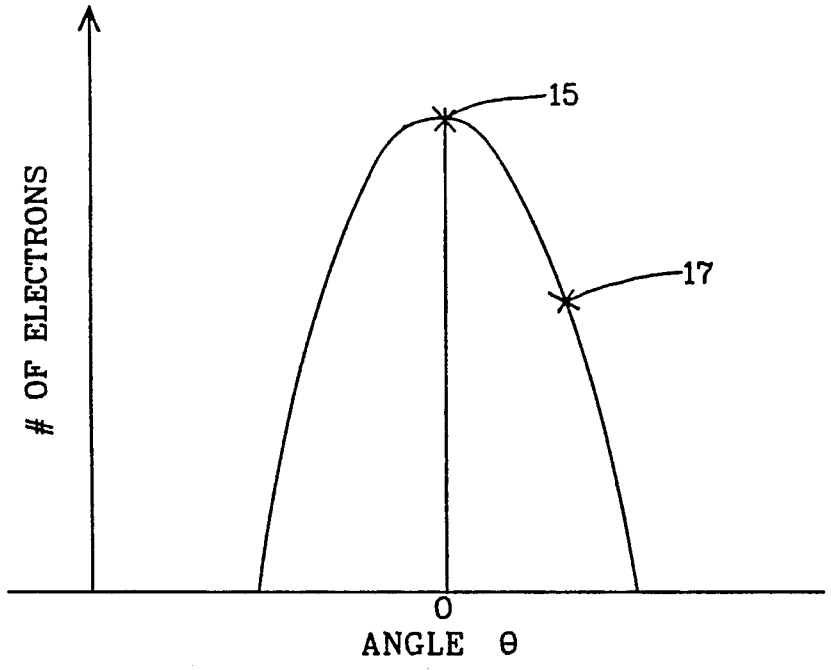
FIG. 2 is a graphic representation of a typical initial angular distribution for a group of photoelectrons simultaneously emitted from a photocathode.

Referring now to FIG. 2, there is shown a graph depicting a typical initial angular distribution for a group of photoelectrons which have been simultaneously emitted from a conventional streak tube photocathode in response to the impinging of light thereon, the distribution being generally cosine squared in shape. The photoelectrons located at an angle equal to zero, e.g. photoelectrons 15, are emitted along the axis of the streak tube whereas the photoelectrons located at an angle other than zero, e.g. photoelectrons 17, are not emitted along the axis of the streak tube. In light of the discussion above with respect to FIG. 1, it can readily be appreciated that the time resolving capacity of a streak camera is degraded by having some photoelectrons traveling along paths other than along the streak tube axis since the off-axis photoelectrons will ultimately strike the phosphor screen at locations different than those struck by the on-axis photoelectrons.

Figure 3:
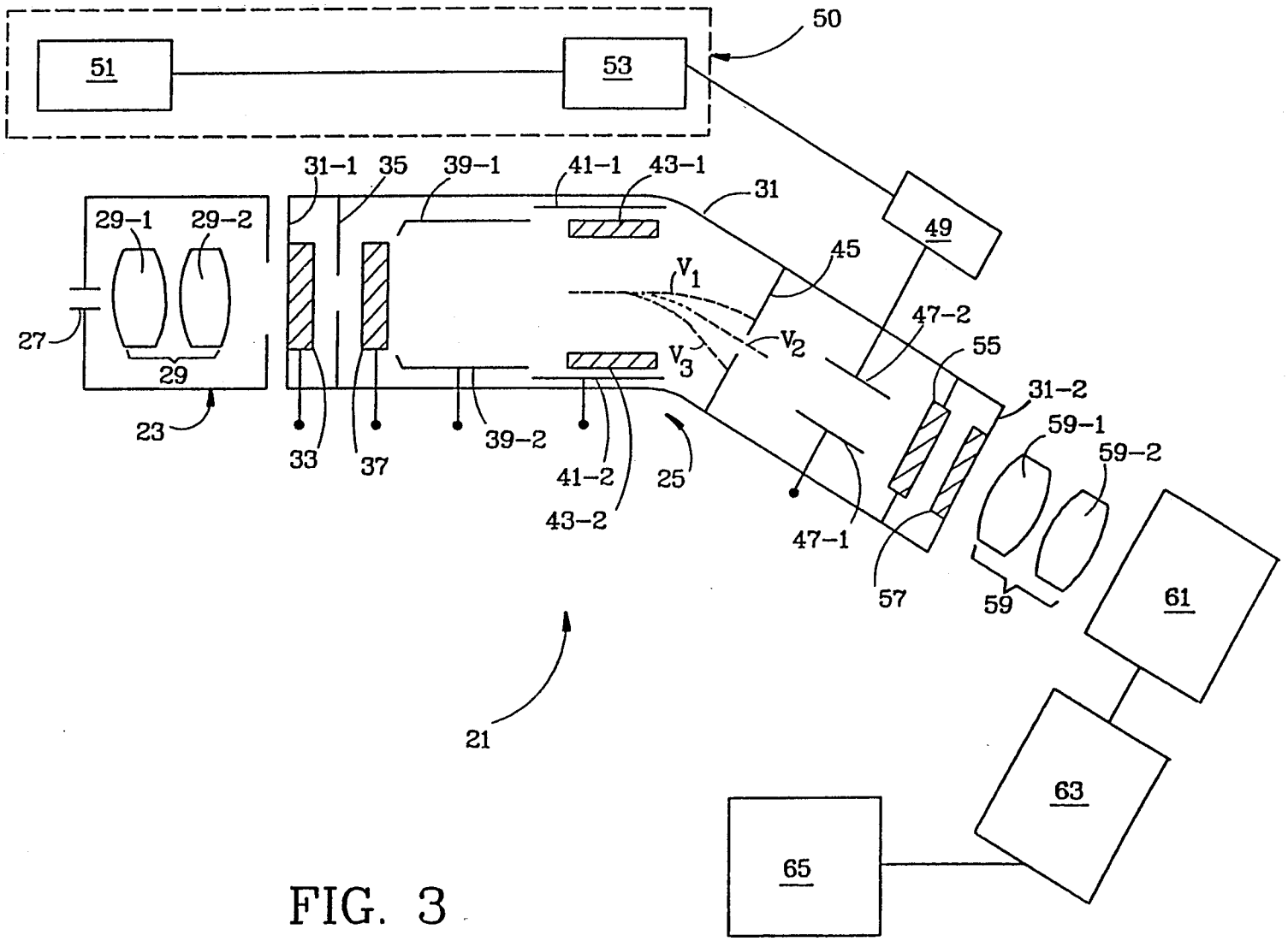
FIG. 3 is a schematic view of one embodiment of a streak camera for time-resolving a pulse of light constructed according to the teachings of the present invention.

Referring now to FIG. 3, there is shown one embodiment of a streak camera having improved time resolution capability, the streak camera being constructed according to the teachings of the present invention and represented generally by reference numeral 21.

Camera 21 includes an input section 23 and a streak tube 25, tube 25, as will be described below in greater detail, being basically a modified streak camera tube. Input section 23 images light incident thereon onto the input end of tube 25, which produces an analog electrical signal whose intensity is proportional to the intensity of the incident light over an ultrashort time window as will hereinafter be explained.

Input section 23 includes an input slit 27 through which the pulse of light to be time-resolved enters. Input slit 27 is preferably rectangular in cross-section but may be a pinhole or any other shape which produces the equivalent of a point source.

Input section 23 also includes optics for focusing an image of slit 27 onto a photocathode disposed at the front of tube 25. As shown in FIG. 3, the optics comprises a lens system 29. Lens system 29 is made up of a first lens 29-1, which is disposed at the focal distance from input slit 27, and a second lens 29-2, which is disposed at the focal distance from the photocathode in tube 25.

Tube 25 comprises a tubular housing 31, which is bent for reasons to be discussed below, housing 31 having an input end 31-1 and an output end 31-2. A conventional photocathode 33, such as S-1, S-20 type photocathodes, a GaAs photocathode or the like, is disposed at input end 31-1 to convert light incident thereon into photoelectrons, which are then emitted in the direction of output end 31-2. An aperture 35, which is preferably on the order of about 1–10 um in diameter and more preferably about 5 um in diameter, is disposed on the output side of photocathode 33 to permit the selective passage therethrough of substantially on-axis photoelectrons for the reasons described above in connection with FIG. 2. The photoelectrons passing through aperture 35 are then accelerated by a conventional accelerating mesh 37 and focused to a beam by a conventional pair of focusing electrodes 39-1 and 39-2 (or a cylindrical electrode). A pair of isolation plates 41-1 and 41-2 (or an isolation cylinder) are disposed within tube 35 to prevent electric and/or magnetic fields originating from sources outside of tube 25 from interfering with the beam of photoelectrons traveling through tube 25.

Tube 25 also includes means for imparting a centrifugal force on the beam of photoelectrons as it travels towards output end 31-2. In the present embodiment, the centrifugal force is preferably magnetic or electrostatic in nature and may be provided by one or more permanent magnets (as seen by magnets 43-1 and 43-2 shown in FIG. 3), one or more current conducting coils, or a pair of electrostatic deflection plates. As the photoelectrons are subjected to the centrifugal force, their trajectories are bent in accordance with their respective velocities, the trajectories of the faster-moving photoelectrons being bent more than those of the slower-moving photoelectrons (as seen by the dotted lines in FIG. 3 representing photoelectrons of three different velocities $v_1$, $v_2$, and $v_3$ wherein $v_1<v_2<v_3$). The relationship between the respective velocities of the photoelectrons and the bending of their trajectories can be expressed mathematically as $$F=(mv^2)/r=evB \quad (2)$$

where m is the mass of a photoelectron, v is its velocity when it arrives at the centrifugal force, r is the radius of motion, e is the charge of the photoelectron, and B is the magnetic field density. Equation (2) can be simplified to $$eB=(mv)/r \quad (3)$$

or, when solved for r, to $$r=(mv)/(eB). \quad (4)$$

Tube 25 also includes an aperture 45 which is disposed within housing 31 after magnets 43. Aperture 45, by its size and placement, serves to filter out only those photoelectrons whose velocities fall within a preselected velocity range. The relationship between the size of aperture 45 and the range of velocities of photoelectrons which can pass therethrough can be expressed as $$dr=(mdv_0)/(eB) \quad (5)$$

where dr is the size of the aperture, m is the mass of a photoelectron, $dv_0$ is the differential of velocities as expressed below in equation (7), e is the charge of a photoelectron, and B is the magnetic field density.

The initial velocity of a photoelectron is related to its initial energy by the equation $$m(v_0)^2/2=E_0 \quad (6)$$

where m is the mass of the photoelectron, $v_0$ is its initial velocity, and $E_0$ is its initial energy. Therefore, the differential change in velocity ($dv_0$) is expressed as $$dv_0=dE_0/(mv) \quad (7)$$

where $dE_0$ is the differential change in energy of the photoelectrons (which can be set equal to ($\Delta\epsilon$)), m is the mass of a photoelectron, and v is the velocity of the photoelectron after it has been accelerated by the acceleration mesh, v being equal to $$v=((v_0)^2+((2eEx)/m))^{0.5} \quad (8)$$

where e is the charge of the photoelectron, E is the accelerating field strength, m is the mass of the photoelectron, and x is the distance between the photocathode and the accelerating mesh.

Using the above calculations, it has been determined that it is possible for a time resolution of 100 fs to be achieved by selecting a centrifugal force of 10 Gauss and an aperture size of 1.7 um or a centrifugal force of 3 Gauss and an aperture size of 5 um. Similarly, it has been determined that it is possible for a time resolution of 50 fs to be achieved by selecting a centrifugal force of 3 Gauss and an aperture size of 1.2 um.

Tube 25 also includes a pair of conventional sweep electrodes 47-1 and 47-2, which act in the typical fashion to sweep those photoelectrons which have passed through aperture 45. Electrodes 47 are driven by a conventional sweep drive circuit 49. Sweep drive circuit 49, which is preferably adjustable in voltage, is triggered by an electrical signal generated by a trigger circuit 50. In the embodiment shown, trigger circuit 50 includes a conventional PIN photodiode 51 and a conventional adjustable delay unit 53. Photodiode 51 converts the optical pulse being time-resolved into an electrical signal, which is then transmitted to delay 53. Delay 53, in turn, delays the arrival of the electrical signal at sweep circuit 49 so as to assist in synchronizing the activation of sweep circuit 49 with the arrival of photoelectrons at sweep electrodes 47.

Instead of using trigger circuit 50 to trigger the activation of sweep drive 49, a trigger circuit such as described in U.S. Pat. No. 5,003,168 to Alfano et al., incorporated herein by reference, may be employed. Such a trigger circuit comprises a low voltage DC power supply, a resistor, a charge line and a photodetector switch all connected in series. The photodetector switch includes a slab of a semi-insulating semiconductor material which becomes photoconductive when actuated by optical radiation. In the absence of optical radiation, the switch is nonconducting and a voltage from the DC power supply builds up in the charge line. When the switch is actuated by optical radiation, it becomes closed, causing the voltage to be discharged to a delay unit and on to the sweep drive circuit. The switch returns to a nonconducting state (i.e. an open state) after about 1.5 nanoseconds. One advantage to using a trigger circuit of this construction is the essential elimination of trigger jitter.

The deflection field created by electrodes 47 causes a rapid sweep of the photoelectrons across a conventional microchannel plate 55, which multiplies the photoelectron signal by a factor of 1000 or more. The intensified beam then impinges upon a phosphor screen 57 wherein the impinging electrons are converted into visible light to thus produce a streak image.

The resulting image formed on phosphor screen 57 is then imaged by a lens system 59 onto the input surface of a silicon-intensified target (SIT), vidicon TV-CCD camera 61, lens system 59 comprising a first lens 59-1 located at the focal distance from screen 57 and a second lens 59-2 located at the focal distance from camera 61. Camera 61 is coupled to a computer 63, which can be used to store and/or process the output from camera 61 and/or to display the output on a monitor 65.

Figure 4:
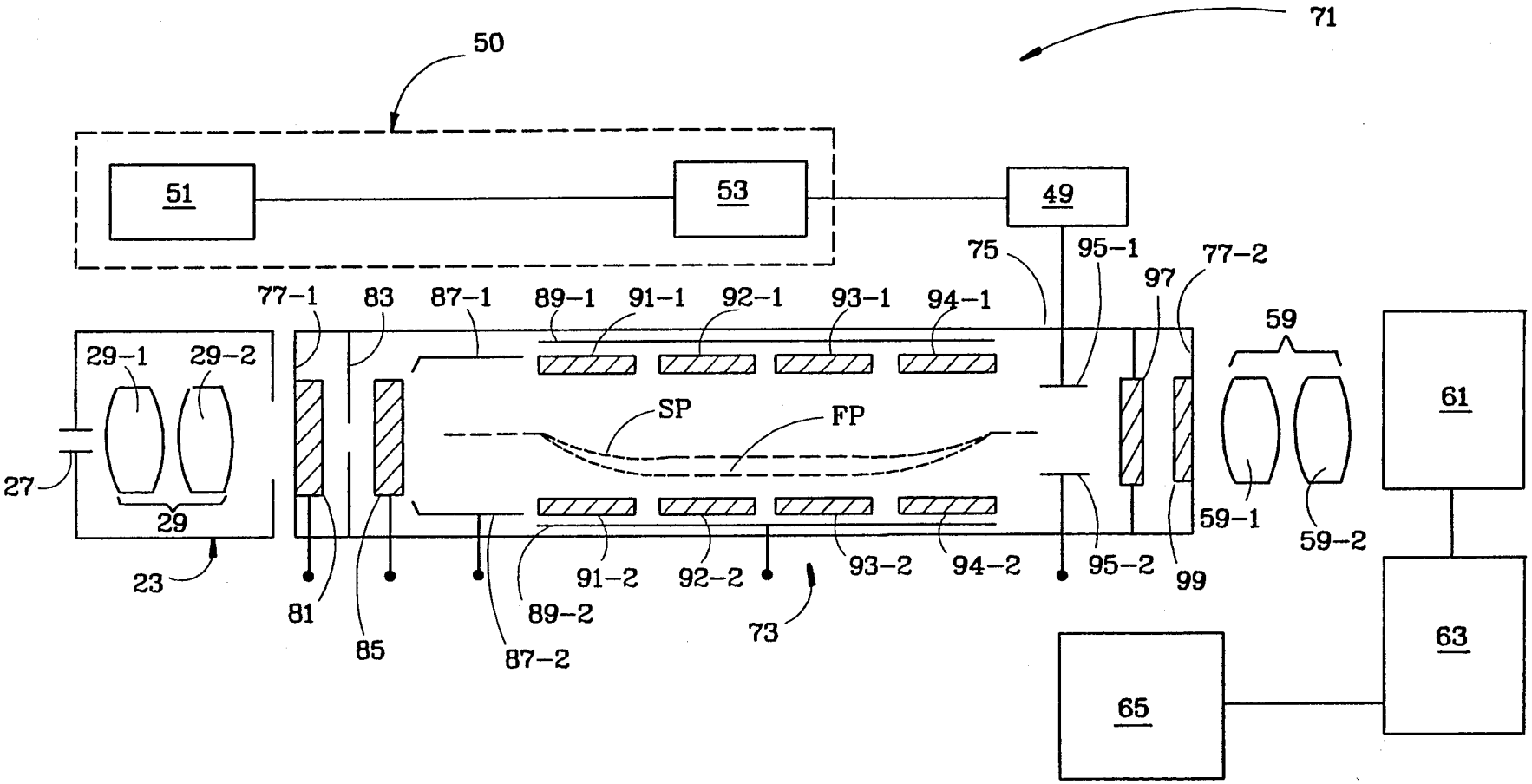
FIG. 4 is a schematic view of a second embodiment of a streak camera for time-resolving a pulse of light constructed according to the teachings of the present invention.

Referring now to FIG. 4, there is shown a second embodiment of a streak camera having improved time resolution capability, the streak camera being constructed according to the teachings of the present invention and represented generally by reference numeral 71.

Streak camera 71 is identical in construction to streak camera 21, except for the construction of its streak camera tube 73 hereinafter described.

Streak camera tube 73 includes a tubular housing 75, which is generally cylindrical in shape and has an input end 77-1 and an output end 77-2. A conventional photocathode 81, such as S1, S20 type photocathodes, a GaAs photocathode or the like, is disposed at input end 77-1 to convert light incident thereon into photoelectrons, which are then emitted in the direction of output end 77-2. An aperture 83, which is preferably about 1-10 um and more preferably 5 um in diameter, is disposed on the output side of photocathode 81 to permit the selective passage therethrough of only on-axis photoelectrons for the reasons described above in connection with FIG. 2. The photoelectrons passing through aperture 83 are then accelerated by a conventional accelerating mesh 85 and focused by a conventional pair of focusing electrodes 87-1 and 87-2 (or a cylindrical focusing electrode). A pair of isolation plates 89-1 and 89-2 (or an isolation cylinder) are disposed within tube 73 to insulate the photoelectrons traveling therein from electric and/or magnetic fields originating from sources outside of tube 73.

Tube 73 also includes means for compressing the photoelectron packet traveling therethrough. In the present embodiment, said compressing means involves making the faster-moving photoelectrons (represented in a portion of tube 73 by the reference letters FP) travel a proportionately greater distance than the slower-moving photoelectrons (represented in a portion of tube 73 by the reference letters SP) so that all of the photoelectrons arrive at the sweeping electrodes at approximately the same time. This is preferably accomplished by having a plurality of electrical or magnetic fields within tube 73, which apply centrifugal forces to the photoelectrons and, therefore, cause their trajectories to be bent to varying extents depending on their respective velocities. The electrical or magnetic fields of the present embodiment are preferably created using permanent magnets, electrical magnets, electrostatic plates, or by similar means. In the embodiment shown, four sets of permanent magnets 91-1 and 91-2 through 94-1 and 94-2 are used to create four magnetic fields, respectively. The first magnetic field is used to disperse the beam of photoelectrons passing therethrough into a plurality of increasingly-curved beams with the slower-moving photoelectrons traveling in the less curved beams and the faster-moving photoelectrons traveling in the more curved beams. The second magnetic field, which has a polarity opposite to that of the first magnetic fields, is used to collimate the various beams. The third magnetic field, which also has a polarity opposite to that of the first magnetic field, is used to cause the beams to converge. Finally, the fourth magnetic field, whose polarity is the same as the first magnetic field, is used to recombine the beams of photoelectrons into a single beam.

The recombined and thus compressed electron beam is then swept by a pair of conventional sweep electrodes 95-1 and 95-2, which act in the typical fashion to cause a rapid sweep of the photoelectrons across a conventional microchannel plate 97, which multiplies the photoelectron signal by a factor of 1000 or more. The intensified beam then impinges upon a phosphor screen 99 wherein the impinging electrons are converted into visible light to thus produce a streak image.

It is considered to be within the scope of the present invention to construct a streak camera which combines the energy filtering features as exemplified by tube 25 and the photoelectron packet compression features as exemplified by tube 73.

Figure 5:
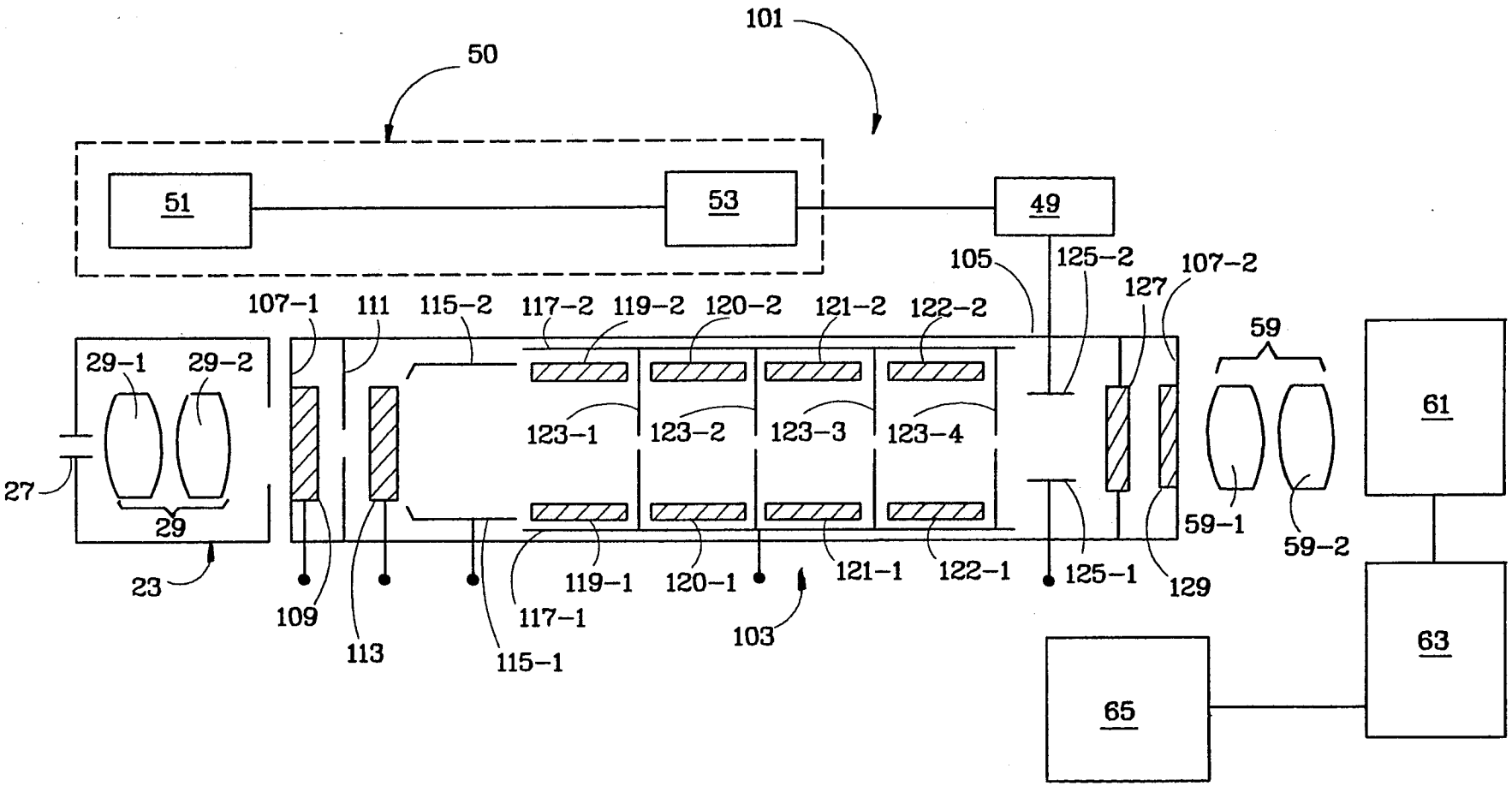
FIG. 5 is a schematic view of a third embodiment of a streak camera for time-resolving a pulse of light constructed according to the teachings of the present invention.

Referring now to FIG. 5, there is shown such an embodiment of a streak camera, the streak camera being constructed according to the teachings of the present invention and represented generally by reference numeral 101.

Streak camera 101 is identical in construction to streak camera 71, except for the construction of its streak camera tube 103 hereinafter described.

Streak camera tube 103 includes a housing 105, which is generally cylindrical in shape and has an input end 107-1 and an output end 107-2. A conventional photocathode 109, such as S1, S20 type photocathodes, a GaAs photocathode or the like, is disposed at input end 107-1 to convert light incident thereon into photoelectrons, which are then emitted in the direction of output end 107-2. An aperture 111, which is preferably about 1-10 um and more preferably 5 um in diameter, is disposed on the output side of photocathode 109 to permit the selective passage therethrough of only on-axis photoelectrons for the reasons described above in connection with FIG. 2. The photoelectrons passing through aperture 111 are then accelerated by a conventional accelerating mesh 113 and focused by a conventional pair of focusing electrodes 115-1 and 115-2 (or a cylindrical focusing electrode). A pair of isolation plates 117-1 and 117-2 (or an isolation cylinder) are disposed within tube 103 to insulate the photoelectrons traveling therein from electric and/or fields originating from sources outside of tube 103.

Tube 103 also includes a plurality of permanent magnets 119-1 and 119-2 through 122-1 and 122-2 which establish magnetic fields of the same polarity and strength as discussed above in connection with magnets 91 through 94. (It is to be understood that electrical magnets, electrostatic plates, and the like may be used instead of permanent magnets.) A plurality of apertures 123-1 through 123-4 are disposed in tube 103, one aperture being disposed after each set of magnets. Apertures 123 serve a variety of purposes. For example, they act as partitions between the individual magnetic fields so as to reduce the effects of cross talk between the fields. In addition, one or more of the apertures (preferably 123-1 and/or 123-2) can be used as energy selectors (in the same manner as aperture 45 of tube 25) to filter out those photoelectrons within a narrow energy band. Such selection should improve the subsequent compression and result in an even greater time resolving capacity.

Tube 103 also includes a pair of conventional sweep electrodes 125-1 and 125-2, which act in the typical fashion to cause a rapid sweep of the filtered and compressed photoelectron beam emerging from aperture 123-4 across a conventional microchannel plate 127, which multiplies the photoelectron signal by a factor of 1000 or more. The intensified beam then impinges upon a phosphor screen 129 wherein the impinging electrons are converted into visible light to thus produce a streak image.

Figure 6A:
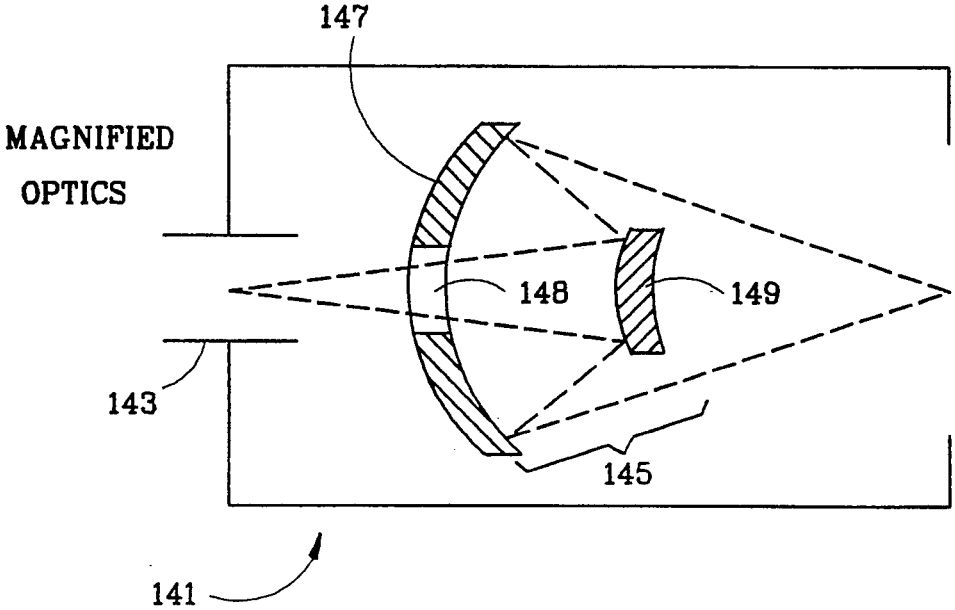
FIGS. 6(*a*) and 6(*b*) are schematic views of alternative streak camera input sections suitable for use with the streak cameras shown in FIGS. 3-5.
Figure 6B:
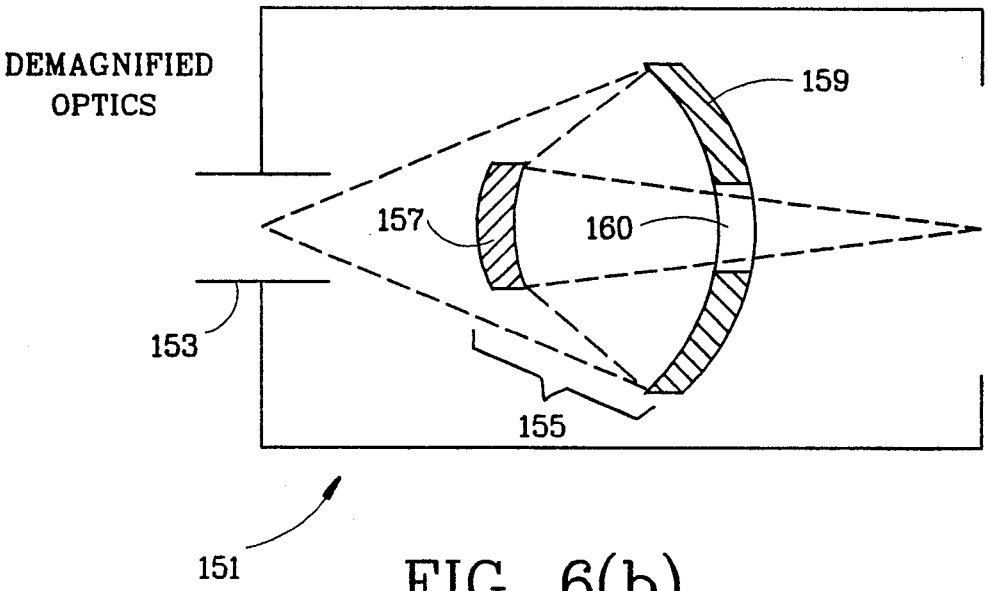

Referring now to FIGS. 6(*a*) and 6(*b*), there are shown an alternative streak camera input sections to be used instead of input section 23 with the streak cameras shown in FIGS. 3-5, the input sections being constructed according to the teachings of the present invention and represented generally by reference numerals 141 and 151, respectively.

Input sections 141 and 151 are similar to input section 23 in that they include input slits 143 and 153, respectively, through which the pulse of light to be time-resolved enters. Input slits 143 and 153 are preferably rectangular in cross-section but may be a pinhole or any other shape which produces the equivalent of a point source.

Input sections 141 and 151, however, differ from input section 23 in that, instead of using lens systems to image the respective input slits onto a photocathode, they use mirror arrangements 145 and 155, respectively. Mirror arrangement 145 includes a large round concave mirror 147 having a centrally disposed hole 148 and a smaller round convex mirror 149. Mirror arrangement 155 includes a small round concave (or convex) mirror 157 and a larger round concave mirror 159 having a centrally disposed hole 160. One reason for using focusing mirrors instead of lenses is that, when an ultrashort light pulse travels through a lens, it becomes dispersed (see U.S. Pat. No. 4,973,160, incorporated herein by reference). This broadening effect is particularly acute when the pulse duration is less than 100 femtoseconds. In contrast, a mirror focusing system has hardly any broadening effect on the pulse duration of pulses as short as 10 femtoseconds.

The embodiments of the present invention are intended to be merely exemplary and those skilled in the art shall be able to make numerous variations and modifications to it without departing from the spirit of the present invention. All such variations and modifications are intended to be within the scope of the present invention as defined by the appended claims.

What is claimed is:

1. A streak camera for time resolving a pulse of light comprising:

a) a streak camera tube comprising i) a housing having an input end and an output end, ii) a photocathode disposed within the housing at said input end for converting light incident thereon into photoelectrons emitted therefrom, those photoelectrons emitted from said photocathode along parallels paths having a velocity distribution, iii) a pair of sweep electrodes for use in sweeping photoelectrons over a defined angular distance at a defined rate, iv) means for screening photoelectrons traveling along a set of parallel paths so that only those photoelectrons whose velocities fall within a velocity range more narrow than the velocity distribution are swept by said pair of sweep electrodes, said screening means comprising means for establishing an electric and/or magnetic field within said housing normal to the axis thereof, whereby the paths of those photoelectrons passing through said electric and/or magnetic field are bent along corresponding trajectories according to their respective velocities, and a first aperture disposed along one or more but less than all of the trajectories, and v) a phosphor screen disposed at said output end of said housing for receiving the swept photoelectrons and for producing a light image in response thereto;

b) an input slit disposed in front of said photocathode;

c) optics for imaging said input slit onto said photocathode;

d) a sweep drive circuit for driving said pair of sweep electrodes; and e) a trigger circuit for triggering said sweep drive circuit.

2. The streak camera as claimed in claim 1 wherein said establishing means comprises one or more magnets disposed within said housing.

3. The streak camera as claimed in claim 1 wherein said electric and/or magnetic field is a magnetic field having a strength of 10 Gauss and wherein said first aperture is 1.7 μm in diameter.

4. The streak camera as claimed in claim 1 wherein said electric and/or magnetic field is a magnetic field having a strength of 3 Gauss and wherein said first aperture is 5 μm in diameter.

5. The streak camera as claimed in claim 1 wherein said electric and/or magnetic field is a magnetic field having a strength of 3 Gauss and wherein said first aperture is 1.2 μm in diameter.

6. The streak camera as claimed in claim 1 and wherein the photoelectrons emitted from said photocathode are distributed over an angle $a_1$ relative to the axis of said housing, the streak camera further comprising angular selecting means, disposed directly after said photocathode, for selecting those photoelectrons emitted from said photocathode within an angle $a_2$ relative to the axis of said housing, said angle $a_2$ being less than said angle $a_1$.

7. The streak camera as claimed in claim 6 wherein said angular selecting means comprises a second aperture.

8. The streak camera as claimed in claim 7 wherein said second aperture is about 1–10 μm in diameter.

9. The streak camera as claimed in claim 1 wherein said optics is substantially dispersionless.

10. A streak camera tube comprising:

a) a housing having an input end and an output end;

b) a photocathode disposed within the housing at said input end for converting light incident thereon into photoelectrons emitted therefrom, those photoelectrons emitted from said photocathode along parallel paths having a velocity distribution;

c) a pair of sweep electrodes for use in sweeping photoelectrons over a defined angular distance at a defined rate;

d) means for screening photoelectrons travelling along a set of parallel paths so that only those photoelectrons whose velocities fall within a velocity range more narrow than the velocity distribution are swept by said pair of sweep electrodes, said screening means comprising means for establishing an electric and/or magnetic field within said housing normal to the axis thereof, whereby the paths of those photoelectrons passing through said electric and/or magnetic field are bent along corresponding trajectories according to their respective velocities, and a first aperture disposed along one or more but less than all of the trajectories; and e) a phosphor screen disposed at said output end of said housing for receiving the swept photoelectrons and for producing a light image in response thereto.

11. The streak camera tube as claimed in claim 10 and wherein the photoelectrons emitted from said photocathode are distributed over an angle $a_1$ relative to the axis of said housing, the streak camera tube further comprising angular selecting means, disposed directly after said photocathode, for selecting those photoelectrons emitted from said photocathode within an angle $a_2$ relative to the axis of said housing, said angle $a_2$ being less than said angle $a_1$.

12. The streak camera tube as claimed in claim 11 wherein said angular selecting means comprises a second aperture.

13. A streak camera for time resolving a pulse of light comprising:

a) a streak camera tube comprising i) a housing having an input end and an output end, ii) a photocathode disposed within the housing at said input end for converting light incident thereon into photoelectrons emitted therefrom, wherein the emitted photoelectrons are distributed over an angle $a_1$ relative to the axis of the housing and wherein photoelectrons travelling along parallel paths have a velocity distribution, iii) a pair of sweep electrodes for use in sweeping photoelectrons over a defined angular distance at a defined rate, iv) angular selecting means, disposed directly after said photocathode, for selecting those photoelectrons emitted from said photocathode within an angle $a_2$ relative to the axis of said housing wherein said angle $a_2$ is less than said angle angle $a_1$, wherein said angular selecting means comprises a first aperture, v) means, disposed after said angular selecting means, for screening photoelectrons travelling along a selected set of parallel paths so that only those photoelectrons whose velocities fall within a velocity range more narrow than the velocity distribution are swept by said pair of sweep electrodes, said screening means comprising means for establishing an electric and/or magnetic field within said housing normal to the axis thereof, whereby the paths of those photoelectrons passing through said electric and/or magnetic field are bent along corresponding trajectories according to their respective velocities, and a second aperture disposed along one or more but less than all of the trajectories, and vi) a phosphor screen disposed at said output end of said housing for receiving the swept photoelectrons and for producing a light image in response thereto, b) an input slit disposed in front of said photocathode;

c) optics for imaging said input slit onto said photocathode;

d) a sweep drive circuit for driving said sweep electrodes; and e) a trigger circuit for triggering said sweep drive circuit.

14. The streak camera as claimed in claim 13 wherein said first aperture is about 1–10 μm in diameter.

15. A streak camera tube comprising:

a) a housing having an input end and an output end;

b) a photocathode disposed within the housing at said input end for converting light incident thereon into photoelectrons emitted therefrom, wherein the emitted photoelectrons are distributed over an angle $a_1$ relative to the axis of the housing and wherein photoelectrons travelling along parallel paths have a velocity distribution;

c) a pair of sweep electrodes for use in sweeping photoelectrons over a defined angular distance at a defined rate;

d) angular selecting means, disposed directly after said photocathode, for selecting those photoelectrons emitted from said photocathode within an angle $a_2$ relative to the axis of said housing wherein said angle $a_2$ is less than said angle $a_1$, wherein said angular selecting means comprises a first aperture;

e) means, disposed after said angular selecting means, for screening photoelectrons travelling along a selected set of parallel paths so that only those photoelectrons whose velocities fall within a velocity range more narrow than the velocity distribution are swept by said pair of sweep electrodes, said screening means comprising means for establishing an electric and/or magnetic field within said housing normal to the axis thereof, whereby the paths of those photoelectrons passing through said electric and/or magnetic field are bent along corresponding trajectories according to their respective velocities, and a second aperture disposed along one or more but less than all of the trajectories; and f) a phosphor screen disposed at said output end of said housing for receiving the swept photoelectrons and for producing a light image in response thereto.

16. The streak camera tube as claimed in claim 15 wherein said first aperture is about 1–10 μm in diameter.

17. A streak camera for time resolving a pulse of light comprising:

a) a streak camera tube comprising
   i) a housing having an input end and an output end,
   ii) a photocathode disposed within the housing at said input end for converting light incident thereon into photoelectrons emitted therefrom, wherein photoelectrons emitted along parallel paths have a velocity distribution,
   iii) a pair of sweep electrodes for use in sweeping photoelectrons over a defined angular distance at a defined rate,
   iv) means disposed between said photocathode and said pair of sweep electrodes for compressing the time differential at which photoelectrons simultaneously emitted from said photocathode along parallel paths arrive at said pair of sweep electrodes, and
   v) a phosphor screen disposed at said output end of said housing for receiving the swept photoelectrons and for producing a light image in response thereto;
b) an input slit disposed in front of the photocathode;
c) optics for imaging said input slit onto said photocathode;
d) a sweep drive circuit for driving said sweep electrodes; and
e) a trigger circuit for triggering said sweep drive circuit.

18. The streak camera as claimed in claim 17 wherein said compressing means comprises means for establishing a plurality of electric and/or magnetic fields, said electric and/or magnetic fields being so configured that photoelectrons travelling along parallel paths and passing therethrough are caused to travel along various trajectories related to their respective velocities and then to be redirected along parallel paths.

19. The streak camera as claimed in claim 18 wherein said establishing means comprises four sets of magnets for establishing four magnetic fields.

20. The streak camera as claimed in claim 19 further comprising an aperture disposed after one of said four sets of magnets, said aperture being sized to select from the photoelectrons those photoelectrons having a velocity falling within a range more narrow than the velocity distribution.

21. The streak camera as claimed in claim 19 further comprising a first aperture disposed between the first and the second of said four sets of magnets, a second aperture disposed between the second and the third of said four sets of magnets, a third aperture disposed between the third and the fourth of said four sets of magnets, and a fourth aperture disposed after the fourth of said four sets of magnets, said four apertures preventing cross talk between the four magnetic fields.

22. The streak camera as claimed in claim 21 wherein either one or both of said first aperture and said second aperture are sized to select from the photoelectrons those photoelectrons having a velocity falling within a range more narrow than the velocity distribution.

23. The streak camera as claimed in claim 17 and wherein the photoelectrons emitted from said photocathode are distributed over an angle $a_1$ relative to the axis of said housing, the streak camera further comprising angular selecting means, disposed directly after said photocathode, for selecting those photoelectrons emitted from said photocathode within an angle $a_2$ relative to the axis of said housing, said angle $a_2$ being less than said angle $a_1$.

24. The streak camera as claimed in claim 23 wherein said angular selecting means comprises an aperture.

25. The streak camera as claimed in claim 24 wherein said aperture is about 1–10 μm long.

26. The streak camera as claimed in claim 20 wherein said optics is substantially dispersionless.

27. A streak camera tube comprising:

a) a housing having an input end and an output end;
b) a photocathode disposed within the housing at said input end for converting light incident thereon into photoelectrons emitted therefrom, wherein photoelectrons emitted along parallel paths have a velocity distribution;
c) a pair of sweep electrodes for use in sweeping photoelectrons over a defined angular distance at a defined rate;
d) means disposed between said photocathode and said pair of sweep electrodes for compressing the time differential at which photoelectrons simultaneously emitted from said photocathode along parallel paths arrive at said pair of sweep electrodes; and
e) a phosphor screen disposed at said output end of said housing for receiving the swept photoelectrons and for producing a light image in response thereto.

28. The streak camera tube as claimed in claim 27 wherein said compressing means comprises means for establishing a plurality of electric and/or magnetic fields, said electric and/or magnetic fields being so configured that photoelectrons travelling along parallel paths and passing therethrough are caused to travel along various trajectories related to their respective velocities and then to be redirected along parallel paths.

29. The streak camera tube as claimed in claim 28 wherein said establishing means comprises four sets of magnets for establishing four magnetic fields.

30. The streak camera tube as claimed in claim 29 further comprising a first aperture disposed between the first and the second of said four sets of magnets, a second aperture disposed between the second and the third of said four sets of magnets, a third aperture disposed between the third and the fourth of said four sets of magnets, and a fourth aperture disposed after the fourth of said four sets of magnets, said four apertures preventing cross talk between the respective electromagnetic fields.

31. The streak camera tube as claimed in claim 30 wherein either one or both of said first aperture and said second aperture are sized to select from the photoelectrons those photoelectrons having a velocity falling within a range more narrow than the velocity distribution.

32. The streak camera tube as claimed in claim 27 and wherein the photoelectrons emitted from said photocathode are distributed over an angle $a_1$ relative to the axis of said housing, the streak camera tube further comprising angular selecting means, disposed directly after said photocathode, for selecting those photoelectrons emitted from said photocathode within an angle $a_2$ relative to the axis of said housing, said angle $a_2$ being less than said angle $a_1$.

33. The streak camera as claimed in claim 32 wherein said angular selecting means comprises an aperture.

34. The streak camera as claimed in claim 33 wherein said aperture is about 1–10 μm in diameter.

* * * * *